US011826008B2

(12) United States Patent
Nezami

(10) Patent No.: US 11,826,008 B2
(45) Date of Patent: Nov. 28, 2023

(54) HOUSEHOLD APPLIANCE WITH A BLOWER AND A FLOW CHANNEL

(71) Applicant: Vorwerk & Co. Interholding GmbH, Wuppertal (DE)

(72) Inventor: Amin Nezami, Wuppertal (DE)

(73) Assignee: Vorwerk & Co. Interholding GmbH, Wuppertal (DE)

( * ) Notice: Subject to any disclaimer, the term of this patent is extended or adjusted under 35 U.S.C. 154(b) by 98 days.

(21) Appl. No.: 17/553,969

(22) Filed: Dec. 17, 2021

(65) Prior Publication Data

US 2022/0192446 A1 Jun. 23, 2022

(30) Foreign Application Priority Data

Dec. 22, 2020 (DE) ..... 10 2020 134 579.8

(51) Int. Cl.

| | |
|---|---|
| ***A47L 9/00*** | (2006.01) |
| ***A47L 5/24*** | (2006.01) |
| ***G10K 11/162*** | (2006.01) |
| ***G10K 11/172*** | (2006.01) |

(52) U.S. Cl.

CPC ..... *A47L 9/0081* (2013.01); *A47L 5/24* (2013.01); *G10K 11/162* (2013.01); *G10K 11/172* (2013.01)

(58) Field of Classification Search

CPC ..... A47L 5/24; A47L 9/0081; G10K 11/162; G10K 11/172; G10K 11/175

USPC ..... 15/326; 181/175

See application file for complete search history.

(56) References Cited

U.S. PATENT DOCUMENTS

| | | | | |
|---|---|---|---|---|
| 2005/0263346 | A1* | 12/2005 | Nishimura | G10K 11/16 181/290 |
| 2012/0233805 | A1* | 9/2012 | Williams | A47L 9/00 15/326 |
| 2020/0245835 | A1* | 8/2020 | Iwakami | A47L 9/22 |
| 2022/0273146 | A1* | 9/2022 | Gray | A47L 5/24 |

* cited by examiner

*Primary Examiner* — Brian D Keller
*Assistant Examiner* — Tim Brady
(74) *Attorney, Agent, or Firm* — Collard & Roe, P.C.

(57) ABSTRACT

A household appliance has a device housing, a blower arranged in the device housing, an outlet opening formed in the flow direction behind the blower in the device housing, and a flow channel. Soundwaves are generated by the blower, and produce resonances characterized by standing waves, which form between opposing inner walls of the flow channel. A sound reducing wall is positioned in the flow channel, the wall plane of which is oriented parallel to a primary flow direction of the air flow guided in the flow channel. The sound reducing wall is positioned in the flow channel so that a maximum for a fast amplitude of a sound particle velocity of the air flow guided in the flow channel lies in the wall plane of the sound reducing wall. The soundwaves form while interspersing the sound reducing wall between the opposing inner walls of the flow channel.

8 Claims, 2 Drawing Sheets

HOUSEHOLD APPLIANCE WITH A BLOWER AND A FLOW CHANNEL

CROSS REFERENCE TO RELATED APPLICATIONS

Applicant claims priority under 35 U.S.C. § 119 of German Application No. 10 2020 134 579.8 filed on Dec. 22, 2020, the disclosure of which is incorporated by reference.

BACKGROUND OF THE INVENTION

1. Field of the Invention

The invention relates to a household appliance, in particular to a floor processing device, with a device housing, a blower arranged in the device housing, an outlet opening formed in the flow direction behind the blower in the device housing, and a flow channel, which connects the outlet opening with the blower in a stream-guiding manner, wherein soundwaves are generated by the blower, which within the flow channel produce resonances characterized by standing waves, which form between opposing inner walls of the flow channel.

2. Description of the Related Art

Household appliances of the aforementioned kind are known in prior art. For example, the latter involve floor processing devices, in particular suction cleaning devices, with a blower for vacuuming dust and dirt from a surface to be cleaned. The suction material is usually transferred by the blower into a suction material chamber, and there collected, while air cleaned by a filter flows to the blower, and finally to the outlet opening.

The operation of the blower and a rotation of the blower blades associated therewith generates soundwaves, which invariably become audible to a user during operation of the household appliance. In order to reduce the background noise associated therewith to an extent where the user no longer perceives it as disruptive, silencers are known in prior art that can be introduced into the device housing of the household appliance.

Further known in prior art, for example in the area of pipe silencers for air ducts, is to provide the interior of flow channels with a perforated support structure, which supports an acoustic foam or a nonwoven. As a result, this increases the pressure loss, so that suction material could no longer be removed as well from a surface to be cleaned in relation to a suction cleaning device as would be the case without such a silencer, for example. In order to offset the negative effect on the efficiency of the silencer, the suction cleaning device would have to be equipped with a more powerful blower or drive motor.

SUMMARY OF THE INVENTION

Proceeding from the aforementioned prior art, it is therefore the object of the invention to further develop a household appliance of the aforementioned kind in such a way as to optimally reduce the noises emitted by the blower, while having the sound reduction measure impair the suction power as little as possible.

In order to achieve this object, it is proposed that a sound reducing wall be positioned in the flow channel, the wall plane of which is oriented parallel to a primary flow direction of the air flow guided in the flow channel, wherein the sound reducing wall is positioned in the flow channel in such a way that a maximum for a fast amplitude of a sound particle velocity of the air flow guided in the flow channel lies in the wall plane of the sound reducing wall, and wherein the soundwaves form while interspersing the sound reducing wall between the opposing inner walls of the flow channel.

According to the invention, a sound reducing wall is thus introduced in the flow channel or formed there in such a way that wall plane of the sound reducing wall lies precisely where the fast amplitude of the sound particle velocity has a maximum. Therefore, the sound reducing wall is spaced apart from the inner wall of the flow channel, and essentially lies centrally within an opening cross section of the flow channel, specifically where the sound particle velocity has a maximum. As a result, the sound-absorbing sound reducing wall is located precisely where an especially high level of sound energy is guided in the air flow. Since the sound reducing wall additionally runs parallel to the primary flow direction of the air flow in the flow channel, the air flow is not significantly impeded, so that the suction force of the blower or the household appliance remains as high as possible. In other words, the sound reducing wall is arranged within the flow channel of the household appliance in such a way that the air flow conveyed by the blower can flow to the outlet opening with the least possible pressure loss within the flow channel, while the sound generated by the blower is on the other hand optimally reduced. The sound reducing wall is essentially oriented parallel to the direction of the air flow within the flow channel, while the soundwaves form between the opposing inner walls of the flow channel, i.e., transversely thereto. As a result, the air flow generated by the blower can flow through the flow channel with the least possible pressure loss, while an optimal acoustic absorption takes place by means of the sound reducing wall arranged in the maximum of the sound particle velocity. As opposed to prior art, it was thus recognized that the known damping measures are arranged too close to the inner wall of the flow channel, where the sound particle velocity already reaches an amplitude minimum, and sound energy can therefore not be effectively absorbed. The sound reducing wall placed according to the invention makes it possible to improve an efficiency of sound reduction to pressure loss by up to 2:1 or even more.

The household appliance that has such a sound reducing wall according to the invention can in particular be a floor processing device, in particular a cleaning device, which has a suction opening and a suction material chamber arranged in a primary flow direction between the suction opening and the blower. The sound reducing wall is especially preferably positioned in the flow channel between the blower and the outlet opening. This means that the sound reducing wall is located on the pressure side or outlet side of the blower, and is thus arranged where the disruptive noises of the blower propagate via the air flow guided in the flow channel. The sound reducing wall is preferably connected with opposing partial areas of the inner wall of the flow channel. Techniques such as bonding, welding or the like can be used for connection purposes. The sound reducing wall can also be held by a support structure, which in turn is fastened to the inner wall of the flow channel.

It is proposed that the sound reducing wall be centrally arranged in the flow channel in relation to an opening cross section of the flow channel. In particular, this relates to an embodiment in which the flow channel is symmetrically designed in a cross section (transverse to a longitudinal extension oriented in the primary flow direction), and the sound reducing wall runs through a symmetry center of the flow channel. The soundwaves generated by the blower of the household appliance cause resonances, which are characterized by so-called standing waves, which form between opposing partial areas of the flow channel. The standing waves arise from the reflections on the soundproof inner walls of the flow channel, which do not allow any absorption of sound energy. By contrast, the phase-offset sound particle velocity has an amplitude approaching zero on the reflecting hard inner walls. The amplitude maximum of the sound particle velocity is rather located in a geometric center between the opposing partial areas of the inner wall of the flow channel. The sound particle velocities of all resonance wavelengths of the sound propagating in the flow channel have a maximum in the middle of a symmetrically flow channel in relation to the cross section. It is here essential that the amplitude maximum of the sound particle velocity be located in the middle of the flow channel, while the amplitude minimums of the sound particle velocity arise on the reflecting inner walls of the flow channel. This applies to all propagating modes standing in the opening cross section. The cross sectional shapes preferred for the flow channel correspond to a circular shape, oval shape, or rectangular shape. The sound reducing wall is preferably arranged in the respective flow channel in such a way that the sound reducing wall forms a symmetry plane of the cross sectional shape of the flow channel.

In addition, it is proposed in particular that an inner wall of the flow channel and the sound reducing wall are spaced apart from each other transverse to the primary flow direction by a distance corresponding to one fourth of a wavelength ($\lambda/4$) of a soundwave emitted by the blower. The flow channel is thus designed appropriate to the resonance frequencies of the flow channel in such a way as to synchronize the wavelength of an acoustically dominant soundwave and a width of the flow channel, specifically so that the distance between the sound reducing wall and the inner wall of the flow channel corresponds to one fourth of a wavelength. Given several relevant resonance wavelengths or relevant secondary maximums, it is basically also possible to arrange several sound reducing walls parallel to each other within the flow channel, for example specifically in the middle of the flow channel on the one hand, and on the other hand, for example, in a plane arranged centrally between the sound reducing wall and the inner wall of the flow channel arranged centrally in the flow channel.

It is proposed that the sound reducing wall have a nonwoven material or foam material. The nonwoven material or foam material forms a flow-permeable sound reducing element, which ensures that sound propagation can take place as unimpeded as possible transverse to the sound reducing wall. In the sense of the invention, it is essential that the sound reducing wall for the sound energy be as free of reflection as possible, and that a majority of sound energy be absorbed by the material of the sound reducing wall. The sound energy is absorbed both via the longitudinal extension of the sound reducing wall in the primary flow direction of the air flow, and also transverse to the longitudinal extension of the wall, specifically via the wall thickness, i.e., the thickness of the sound reducing wall. The amount of absorbed sound energy is proportional to the amount of the surface of the acoustically active sound reducing wall. The material used to form the sound reducing wall can further influence the amount of absorption. The use of a fiber-reinforced nonwoven has here proven to be particularly advantageous. In relation to the volume, the nonwoven can preferably be 20% to 40% fiber reinforced. Particularly preferably, the nonwoven is 30% fiber reinforced. In addition, the nonwoven can preferably be woven. In this conjunction, fiber-reinforced means that the nonwoven, which in particular consists of polypropylene or polystyrene, is stiffened with the help of glass and/or carbon fibers.

Finally, it is proposed that the sound reducing wall have a wall thickness of several millimeters. In particular, a wall thickness of between 1 mm and 10 mm has proven to be especially advantageous. The wall thickness especially preferably measures between 3 mm and 6 mm. The thickness of the sound reducing wall, i.e., its wall thickness, can be used to set a wavelength range that is optimally absorbed by the sound reducing wall. This makes it possible to compensate even for slight changes in sound wavelength, for example which are caused by a slightly changed rotational frequency of the blower, or by a slight change in the shape of the flow channel.

BRIEF DESCRIPTION OF THE DRAWINGS

Other objects and features of the invention will become apparent from the following detailed description considered in connection with the accompanying drawings. It is to be understood, however, that the drawings are designed as an illustration only and not as a definition of the limits of the invention.

In the drawings.

DETAILED DESCRIPTION OF PREFERRED EMBODIMENTS

Figure 1:
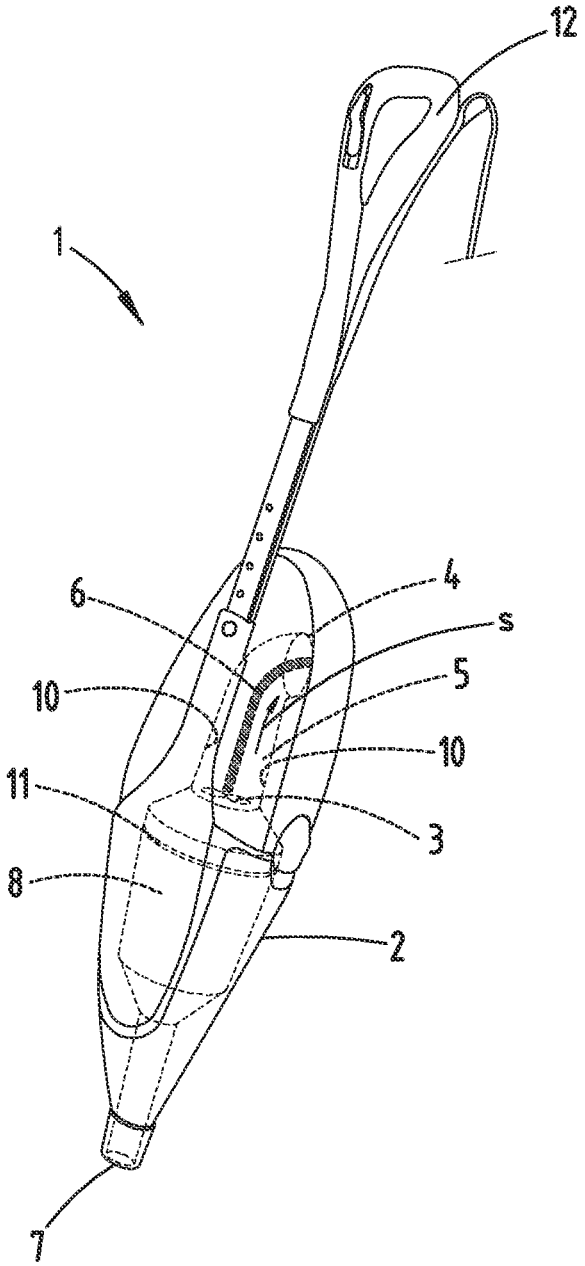
FIG. 1 is a household appliance according to the invention.

FIG. 1 initially shows a household appliance 1 in the form of a floor processing device, here for example as a vacuum cleaner manually guided by a user. The household appliance 1 has a handle 12, with which the user can guide the household appliance 1 over a surface to be cleaned, so as to vacuum suction material, i.e., dust and/or dirt, into a suction material chamber 8. The household appliance 1 has an electric motor-driven blower 3, which sucks the suction material into the suction material chamber 8 proceeding from a suction opening 7. A filter element 11 allocated to the suction material chamber 8 filters the suction material out of the sucked in air, so that only cleaned air flows on to the blower 3. Located in the flow direction behind the blower 3, i.e., on the pressure side of the blower 3, is a flow channel 5, which leads to an outlet opening. The outlet opening 4 is located on a wall of a device housing 2 of the household appliance 1. Proceeding from the blower 3 to the outlet opening 4, the flow channel 5 prescribes a primary flow direction s for the air flow guided in the flow channel 5. Instead of the embodiment only shown exemplarily here, the flow channel 5 can also have a deviating shape, for example a rectangular cross section instead of a round cross section. The flow channel 5 can also run straight instead of bent relative to the outlet opening 4. In addition, it is possible that the cross sectional shape of the flow channel 5 change in the direction of longitudinal extension.

A sound reducing wall 6 is arranged in the flow channel 5, and here for example consists of a fiber-reinforced nonwoven. For example, a wall thickness d of the sound reducing wall 6 here measures approx. 4 mm or below. In the exemplary embodiment here, the sound reducing wall 6 runs in the flow channel 5, completely from the blower 3 to the outlet opening 4. However, it is also possible that the sound reducing wall 6 only be formed over a portion of the length of the flow channel 5, and for example have a length of only a few centimeters. The sound reducing wall 6 especially preferably extends centrally within the flow channel 5, possibly even parallel to opposing inner walls 10 of a flow channel 5 with a rectangular cross section.

Figure 2:
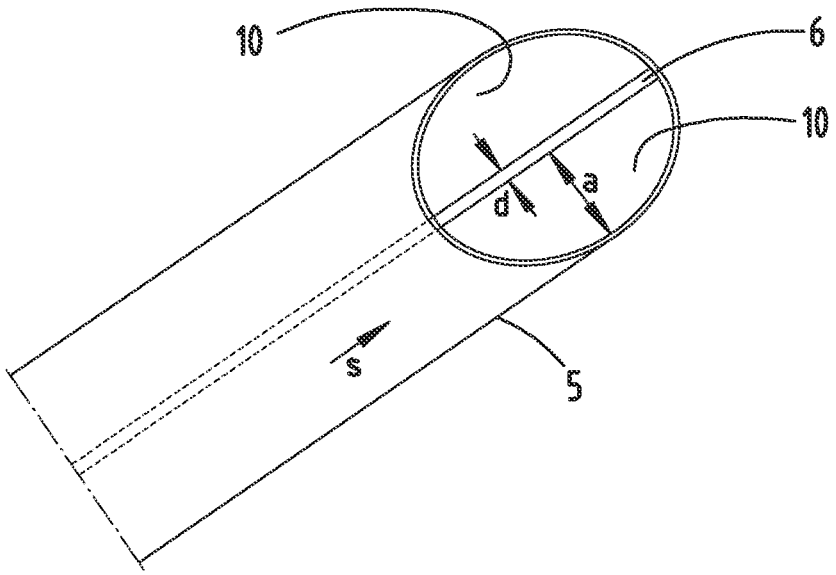
FIG. 2 is a flow channel with a sound reducing wall.

FIG. 2 shows a cross section of the flow channel 5 transverse to a longitudinal extension of the flow channel 5 in a primary flow direction s. As depicted, the sound reducing wall 6 is arranged centrally within the flow channel 5, which is here round, for example, specifically in such a way that the sound reducing wall 6 forms a symmetry plane of the cylindrically designed flow channel 5. An identical distance a to a respective partial area of an inner wall 10 of the flow channel 5 exists on both sides of the sound reducing wall 6. As already mentioned, shapes other than the cylindrical shape of the flow channel 5 shown here are also conceivable, for example an oval or rectangular cross sectional shape of the flow channel 5. It is essential that the sound reducing wall 6 is formed and arranged within the flow channel 5 in such a way that the sound reducing wall 6 runs parallel to the primary flow direction s within the flow channel 5 on the one hand, and is centrally arranged in the flow channel 5 on the other, specifically in such a way that the distances a to both sides of the sound reducing wall 6 are identical. Relative to its longitudinal extension, the flow channel 5 can also just sectionally have a sound reducing wall 6, or several sound reducing walls 6 one behind the other.

Figure 3:
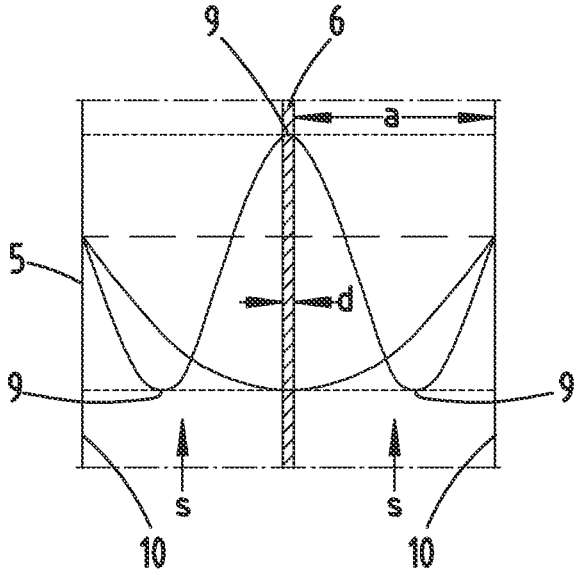
FIG. 3 is a schematic sketch of the function of the sound reducing wall.

FIG. 3 shows a longitudinal section through a partial area of the flow channel 5. Exemplarily shown are two resonance modes with the wavelengths $\lambda/2$ and $3\ \lambda/2$. The distance a between the sound reducing wall 6 and the inner wall 10 of the flow channel 5 is dimensioned in such a way that its amount corresponds to one fourth of the wavelength of a base mode formed within the flow channel 5. The progression of the depicted oscillation modes of the resonance wave reflects the locally varying amplitudes of the sound energy of the resonance wave, i.e., a fast amplitude 9 of the sound particle velocity that runs transverse to the primary flow direction s of the air flow guided in the flow channel 5. As discernible on FIG. 3, the sound particle velocity, and hence also the sound energy, has a maximum in the geometric center of the flow channel 5, where the distance a to the adjacent inner wall 10 is identical on both sides of the sound reducing wall 6. According to the invention, the sound reducing wall 6 is placed precisely in this plane, which is characterized by the maximum of the fast amplitude 9, so as to there absorb the sound energy by means of the nonwoven material 24. In the area of the inner wall 10 of the flow channel 5, the fast amplitude 9 or the sound energy is essentially equal to zero, so that it would not be required or effective to place a sound absorption material there. The standing wave can propagate transverse to the sound reducing wall 6 unimpeded, i.e., as reflection-free as possible, due to the sound-permeable property of the material of the sound reducing wall 6. As a whole, the sound energy of the resonance wave formed in the flow channel 5 is thus effectively reduced, wherein the air flow can simultaneously flow through the flow channel 5 in the direction of the outlet opening 4 with as little loss in pressure as possible in the primary flow direction s. For example, the efficiency of the sound reducing wall 6, i.e., the sound reduction in relation to a pressure loss within the flow channel 5, measures 2:1 or above, which by comparison with prior art means a distinctly higher efficiency.

Although only a few embodiments of the present invention have been shown and described, it is to be understood that many changes and modifications may be made thereunto without departing from the spirit and scope of the invention.

REFERENCE LIST

| | |
|---|---|
| 1 | Household appliance |
| 2 | Device housing |
| 3 | Blower |
| 4 | Outlet opening |
| 5 | Flow channel |
| 6 | Sound reducing wall |
| 7 | Suction opening |
| 8 | Suction material chamber |
| 9 | Fast amplitude |
| 10 | Inner wall |
| 11 | Filter element |
| 12 | Handle |
| a | Distance |
| d | Wall thickness |
| s | Primary flow direction |

What is claimed is:

1. A household appliance comprising:

a device housing, a blower arranged in the device housing, an outlet opening formed in a flow direction behind the blower in the device housing, and a flow channel, which connects the outlet opening with the blower in a stream-guiding manner, wherein the blower is configured to generate soundwaves within the flow channel that produce resonances characterized by standing waves between opposing inner walls of the flow channel, wherein a sound reducing wall is positioned in the flow channel, a wall plane of which is oriented parallel to a primary flow direction (s) of the air flow guided in the flow channel, wherein the sound reducing wall is positioned in the flow channel so that a maximum for a fast amplitude of a sound particle velocity of the air flow guided in the flow channel lies in a wall plane of the sound reducing wall, and wherein the soundwaves form between the opposing inner walls of the flow channel while interspersing the sound reducing wall between the opposing inner walls, such that the soundwaves propagate through the sound reducing wall, wherein the sound reducing wall is centrally arranged in the flow channel in relation to an opening cross section of the flow channel, and wherein an inner wall of the flow channel and the sound reducing wall are spaced apart from each other transverse to the primary flow direction (s) by a distance (a) corresponding to one fourth ($\lambda/4$) of a wavelength of a soundwave emitted by the blower.

2. The household appliance according to claim 1, wherein the household appliance is a floor processing device, in particular a cleaning device, with a suction opening and a suction material chamber arranged in a primary flow direction (s) between the suction opening and the blower.

3. The household appliance according to claim 1, wherein the sound reducing wall is positioned in the flow channel between the blower and the outlet opening.

4. The household appliance according to claim 1, wherein the flow channel is symmetrically designed in a cross section transverse to a longitudinal extension oriented in the primary flow direction (s), and the sound reducing wall runs through a symmetry center of the flow channel.

5. The household appliance according to claim 1, wherein the sound reducing wall is comprised of a nonwoven material or foam material.

6. The household appliance according to claim 1, wherein the sound reducing wall has a wall thickness (d) of several millimeters.

7. The household appliance according to claim 1, wherein the sound reducing wall has a wall thickness (d) of between 1 mm and 10 mm.

8. The household appliance according to claim 7, wherein the wall thickness (d) is between 3 mm and 6 mm.

* * * * *